United States Patent [19]

Harrel

[11] 4,054,830

[45] Oct. 18, 1977

[54] REGULATED POWER SUPPLY

[75] Inventor: Jack D. Harrel, Waynesboro, Pa.

[73] Assignee: Landis Tool Company, Waynesboro, Pa.

[21] Appl. No.: 454,322

[22] Filed: Mar. 25, 1974

[51] Int. Cl.[2] ..... G05F 1/58

[52] U.S. Cl. ..... 323/8; 323/9; 323/23; 361/18

[58] Field of Search ..... 317/20, 31, 33 VR; 323/9, 23, 25; 321/18; 361/18

[56] References Cited

U.S. PATENT DOCUMENTS

| | | | |
|---|---|---|---|
| 2,967,991 | 1/1961 | Deuitch | 323/25 X |
| 3,094,654 | 6/1963 | Roelli | 323/23 X |
| 3,304,489 | 2/1967 | Brolin et al. | 323/9 |
| 3,474,296 | 10/1969 | Rickey | 317/31 |
| 3,527,997 | 9/1970 | Nercessian | 317/33 VR |
| 3,551,745 | 12/1970 | Nicholas | 317/33 VR |

*Primary Examiner*—A. D. Pellinen

[57] ABSTRACT

A stable and reliable d.c. power supply is characterized by a regulator between input and output terminals in combination with parallel current paths to a load which are sequentially established to carry the major portion of current to the load as current increases. The power supply includes an excessive current detector and a load overvoltage and undervoltage detector, respectively, to short out the load and open the power supply circuit.

9 Claims, 2 Drawing Figures

REGULATED POWER SUPPLY

Figure 1:
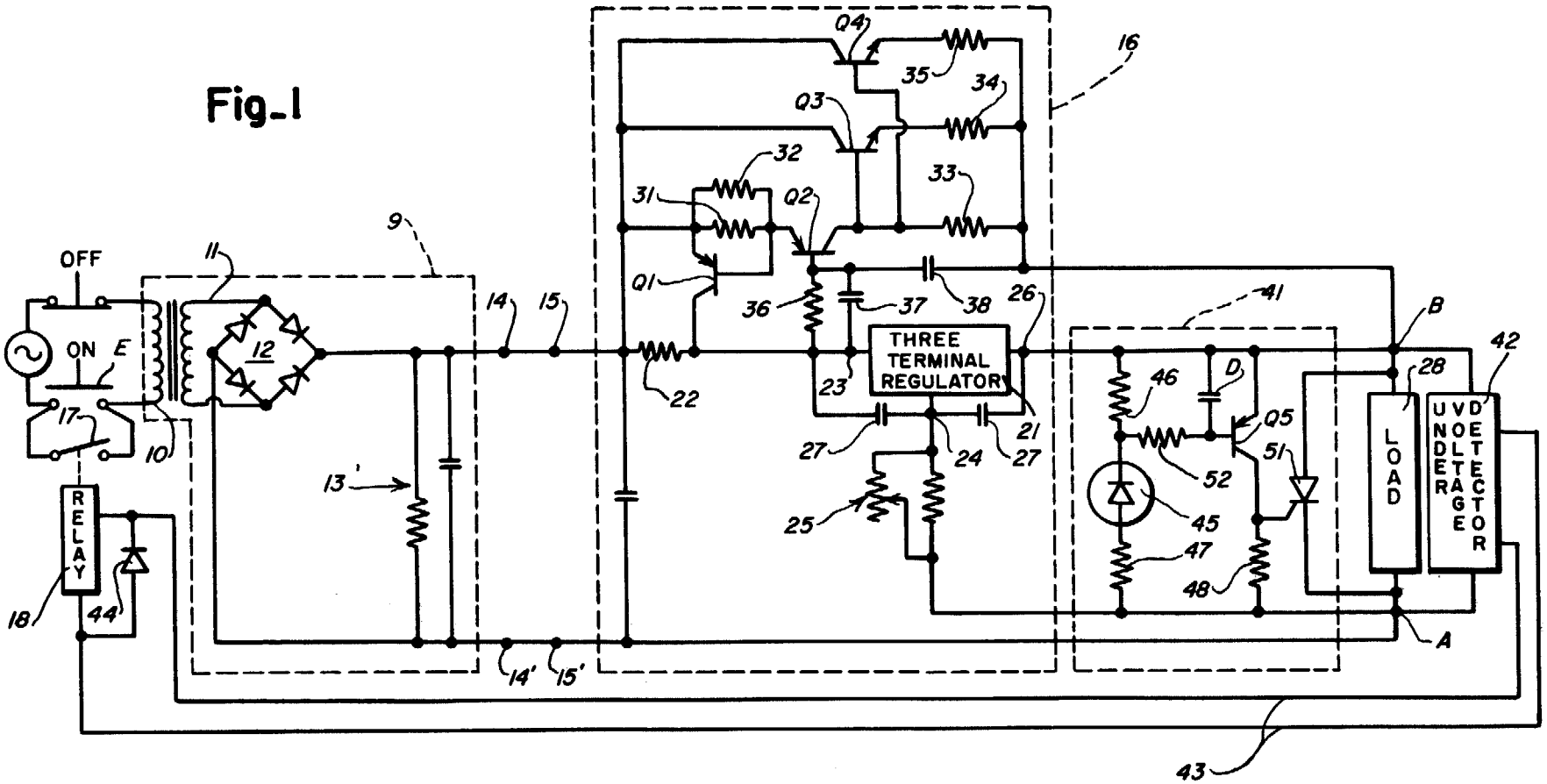

This invention relates to regulated power supplies which serve to maintain voltage across a load constant; more particularly, it relates to a regulated power supply having a regulator between input and output terminals and current paths in parallel therewith to share the load current; and specifically, to a regulated power supply in which the parallel current paths are sequentially established in response to increasing load current.

An object of the invention is in the provision of a stable and reliable regulated d.c. power supply for maintaining a constant voltage across a variable load.

Another object of the invention is in the provision of a regulated power supply which is operable in a machine tool environment without being effected by electrical noise from associated relay circuitry or electrical components.

Another object of the invention is in the provision of a regulated power supply which avoids the constant hunting characteristic of feedback regulating systems.

Another object of the invention is in the provision of a regulated power supply wherein current through a regulator is monitored and the magnitude is employed to sequentially establish parallel current paths to the load to assist the regulator as current drawn by the load increases.

A feature of the invention resides in the provision of a current sensing circuit which is preset to the maximum current capability of a power supply transformer and serves in combination with a load undervoltage detector to effect an open circuit between power supply and source a.c. voltage.

An additional feature of the invention is in the provision of a load overvoltage detector to short out the load and in combination with a load undervoltage detector to open circuit the load supply.

Other objects and attendant advantages of this invention will be readily appreciated as the same becomes better understood by reference to the following detailed description when considered in connection with the accompanying drawing in which like reference numerals designate like or corresponding elements throughout the several views and wherein.

Figure 2:
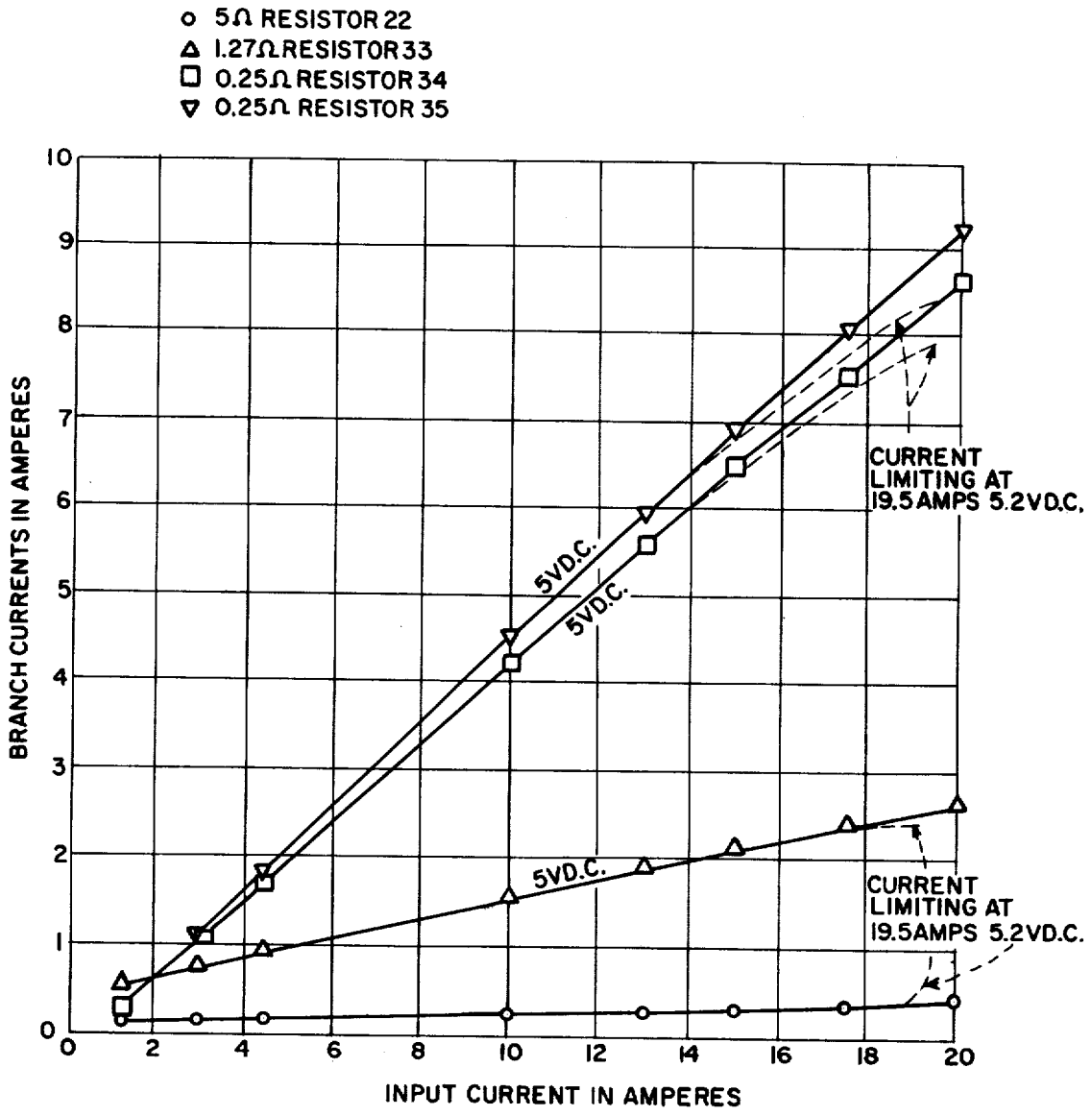

FIG. 1 is a schematic view of a regulated voltage control circuit embodying the invention; and FIG. 2 is a chart illustrating the current distribution through the regulating power supply.

Referring now to FIG. 1 of the drawing, there is provided a source voltage supply generally designated by reference 9 comprising a step down transformer whose primary 10 is connected to a.c. lines and whose secondary 11 is connected to the input terminals of a full wave rectifier 12 whose output passes through a filter section 13. The rectified and filtered voltage at source voltage output terminals 14, 14' is connected to the input terminals 15, 15' of a regulating and current assist circuit generally designated by reference 16 designed to maintain a desired voltage constant across a load.

The source voltage supply 9 may be separated from the current assist circuit 16 by a distance up to fifty feet, without effecting the output characteristics of the regulator. This permits the major heat producing components to be isolated from the electronic circuitry, and thus reduces the cooling capacity requirement for the electronic circuitry.

The circuit 16 comprises a Fairchild VA7805 three terminal voltage regulator generally designated by reference number 21 capable of handling one amp. These regulators serve to control current to the load to maintain the voltage thereacross constant. The positive terminal 15 of the source voltage is connected via a resistor 22 to the input terminal 23 of the regulator 21. The common terminal 24 of the regulator is connected to the negative terminal A of a load 28 through a bias adjusting resistor arrangement designated 25 to set the voltage at the output terminal 26 of the regulator relative to terminal A at a desired load voltage. Capacitors 27 connected between the input and output terminals 23 and 26 and the common terminal 24 of the voltage regulator 21 serve to prevent oscillation. The load 28 across which a constant voltage is to be maintained despite input voltage variations or load current variations is connected across regulator terminal 26 and the reference terminal A. Regulator input terminal 15 is also connected to the emitter of the first PNP transistor Q1 whose collector is connected to the low end of resistor 22. Terminal 15 is also connected via resistor 31, paralleled by a current trim resistor 32 to the emitter of a first pass PNP transistor Q2 whose collector is connected via a resistor 33 to the positive terminal B of the load 28. The terminal 15 is also connected to the collectors of NPN pass transistors Q3 and Q4 whose emitters are connected via current balance resistors 34 and 35 to the terminal B. The bases of transistors Q3 and Q4 are both connected to the collector of PNP transistor Q2 whose base is connected to the input terminal 23 of the voltage regulator by resistor 36. Capacitors 27 and 38 connect the base of transistor Q2 to the input 23 of the regulator 21 and terminal B of the load. These capacitors serve to handle transients and prevent oscillation. The base of transistor Q1 is connected to the low side of resistor 31.

Connected across the load 28 is an undervoltage circuit generally designated by reference 42 whose output lines 43 are connected across to the coil of a relay 18. A diode 44 is connected across the relay coil to handle transients. The undervoltage circuit responds to abnormal voltage drops across the load with the result that current in output lines 43 reduces sufficiently to cause current reduction through relay 18 and open a switch 17 in parallel with the ON button E in the a.c. source lines to the transformer primary 10.

The overvoltage circuit 41 connected across terminals 26 and A includes a first series branch including a Zener diode 45 and current limiting resistors 46 and 47. A second series branch includes a PNP transistor Q5 whose emitter is connected to terminal 26 and whose collector is connected via resistor 48 to terminal A. A third branch includes a SCR 51. As shown in FIG. 1, the cathode of the Zener diode 45 is coupled by a resistor 52 to the base of PNP transistor Q5 and the collector of Q5 is connected to trigger the SCR 51.

The three terminal regulator 21 is connected to the load 28 via the termnal 26 to terminal B connection and the terminal 24 to terminal A connection and is attempting to supply the required load current directly. The input current to the regulator 21 develops a voltage across the resistor 22 causing conduction of transistor Q2, and resulting in load current via the resistor 31, Q2, and resistor 33 circuit. Voltage drop across resistor 33 causes conduction through transistors Q3, 34 and Q4, 35 resulting in increased load current in a cascading manner as shown in FIG. 2. During the time required to establish the voltage regulator current assist paths and to establish the desired voltage across the load the signal on output lines 43 of the undervoltage detector 42 increases to operate relay 18 and lock the a.c. circuit established by ON pushbutton D.

Thereafter the voltage regulator 21 will increase or decrease current within limits according to input voltage variations or load demands to maintain voltage across the load constant. From the preceding, it is evident that load current builds up without the constant hunting characteristic of a feed back system in that as the load draws current, the initial current is through the voltage regulator and as it increases the PNP transistor establishes a first current assist path and further increases establish additional current assist paths through NPN transistors Q3 and Q4. The advantage of this sequential addition of current paths is freedom from 37 hunting", i.e. continual over and under shoot of the voltage regulator 21. Resistance and capacitance value are very low providing fast response time with reasonable efficiency and heat dissipation characteristics. At full load of, for example 20 amperes, the regulator 21 carries .5 amps; the PNP transistor 2.5; and the NPN transistors divide the remaining current equally as shown in FIG. 2.

Should the current drawn exceed the capability of the supply transformer, the current drawn through the path including resistor 31, which with transistor Q1 establishes a current sensing circuit preset to the capability of the transformer, the voltage drop across resistor 31 increases and the base emitter voltage of Q1 increases with the result that transistor Q1 conducts and shorts out the first and second established current assists paths through Q2, Q3 and Q4 with the result that the voltage regulator 21 is called upon to assume all of the current being drawn by the load. This causes a thermal overload, reducing the current through the regulator 21 with the result that the voltage across the load will drop abnormally, be detected by the undervoltage detector 42 and switch 17 will be opened.

Should the voltage across the load exceed a predetermined magnitude raising the collector base voltage of transistor Q5 whose base is clamped to the voltage across the Zener diode 45 resistor 47, transistor Q5 will conduct and the resulting drop across resistor 48 will trigger SCR 51 shorting out the load. The resulting drop of voltage will again operate the undervoltage detector 42 and open switch 17.

What I claim is:

1. A power supply comprising a source of d.c. voltage to be regulated, source voltage output terminals, a voltage regulator having a pair of input terminals and a pair of output terminals, means connecting said source voltage output terminals to the input terminals of said regulator, a load connected across the output terminals of said regulator, first means responsive to a predetermined magnitude of current flowing through said regulator for establishing a first parallel current path between said source terminals and regulator output terminals, and second means responsive to current flowing in said established first path for establishing additional second current paths between said source terminals, and said regulator output terminals, said regulator responding to load current changes for maintaining the voltage across the load constant, said first established current path including excessive current detecting means for shorting out said first and second established current paths whereby all of the current is directed through said regulator and is limited thereby causing the voltage across the load to decrease, and means responsive to a decrease in voltage across the load for open circuiting said source.

2. A power supply as recited in claim 1, said excessive current detecting means comprising a resistor in said established first current path, a transistor having its emitter and collector respectively connected to one of said source terminals and one said regulator input terminals, and having its emitter and base connected respectively to opposite ends of said resistor whereby excessive current through said resistor will cause said transistor to conduct and short out said first and additional established current paths.

3. A power supply as recited in claim 1, further including means responsive to a voltage magnitude across said load in excess of said constant voltage for shorting out said load, said means responsive to a decrease in voltage across said load open circuiting said source as a result of the shorting of said load.

4. A power supply as recited in claim 3, said means responsive to excessive voltage across said load comprising a Zener diode and a series resistor connected across said load, a transistor and a series resistor connected across said load, means coupling the voltage developed across said Zener diode and series resistor to the base of said transistor to render the same conductive when the voltage across the load exceeds a predetermined magnitude, and an SCR connected across said load responsive to the voltage developed across said resistor in series with said transistor for shorting out said load.

5. A power supply comprising a regulating and current assist circuit for receiving D.C. power and for supplying regulated D.C. power to a load, said circuit including a first current path having a three terminal regulator connected across the load, capable of handling current less than a predetermined maximum current, at least one bypass current path connected in parallel with said first current for bypassing an amount of current which is at least equal to the difference between the total current flowing through said regulating and current assist circuit and said maximum current of the regulator, when the total current is less than a selected current, and means for directing all of the current to said regulator when the total current exceeds the selected current, whereby the current flow through the regulator will exceed the capability of the regulator resulting in the regulator operating in a current limiting mode.

6. A power supply according to claim 5, wherein said directing means comprises a transistor connected between said bypass current path and the input terminal of said regulator.

7. A power supply according to claim 6, wherein said bypass current path includes a transistor.

8. A power supply according to claim 6, wherein said regulating and current assist circuit includes a plurality of bypass current paths and each of said bypass paths includes a transistor.

9. A power supply according to claim 8, wherein one of said bypass transistors powers the other bypass transistors.

* * * * *